US006265064B1

(12) United States Patent
Mori

(10) Patent No.: US 6,265,064 B1
(45) Date of Patent: Jul. 24, 2001

(54) NATURAL FIBERS CONTAINING TITANIUM OXIDE AND PROCESS FOR PRODUCING THE SAME

(75) Inventor: Takefumi Mori, Haguri-gun (JP)

(73) Assignees: Kyorasha Co., Ltd., Kyoto; Moritoshi Kabushikikaisha, Aichi, both of (JP)

( * ) Notice: Subject to any disclaimer, the term of this patent is extended or adjusted under 35 U.S.C. 154(b) by 0 days.

(21) Appl. No.: 09/424,032

(22) PCT Filed: May 18, 1998

(86) PCT No.: PCT/JP98/02188

§ 371 Date: Nov. 17, 1999

§ 102(e) Date: Nov. 17, 1999

(87) PCT Pub. No.: WO98/53132

PCT Pub. Date: Nov. 26, 1998

(30) Foreign Application Priority Data

May 23, 1997 (JP) ..... 9-133923

(51) Int. Cl.[7] ..... D01F 6/00; D01F 7/00

(52) U.S. Cl. ..... 428/372; 428/395; 428/375; 427/523; 427/189

(58) Field of Search ..... 428/372, 393, 428/375; 427/523, 189; 203/687, 159

(56) References Cited

U.S. PATENT DOCUMENTS

| | | | | |
|---|---|---|---|---|
| 5,804,296 | * | 8/1998 | Itoh et al. | 428/326 |
| 5,919,422 | * | 7/1999 | Yamanaka et al. | 422/121 |

FOREIGN PATENT DOCUMENTS

| | | |
|---|---|---|
| 60-65179 | 4/1985 | (JP) . |
| 63-86205 | 4/1988 | (JP) . |
| 1-93443 | 4/1989 | (JP) . |
| 5-286738 | 11/1993 | (JP) . |
| 6-240570 | 8/1994 | (JP) . |
| 8-66635 | 3/1996 | (JP) . |

OTHER PUBLICATIONS

*Chemical Treatments Designed to Modify the Affinity of Wool for Dyes*. Bell, et al. JSDC vol. 100. Jul./Aug. 1984. 223–231.

* cited by examiner

*Primary Examiner*—N. Edwards
(74) *Attorney, Agent, or Firm*—Merchant & Gould P.C.

(57) ABSTRACT

The invention is directed to a natural organic fiber having a surface that is plated with titanium oxide, wherein deterioration of said natural organic fiber by titanium oxide does not occur; and wherein the titanium oxide is closely attached to the surface of the natural organic fiber.

20 Claims, No Drawings

NATURAL FIBERS CONTAINING TITANIUM OXIDE AND PROCESS FOR PRODUCING THE SAME

TECHNICAL FIELD

The present invention relates to a natural fiber containing titanium oxide having various functions such as a deodorizing function, a stain resisting (stain proofing or stain releasing) function, an antibacterial function, and the like, by a photo-catalytic action of titanium oxide, and to a process for producing the same.

BACKGROUND ART

It conventionally has been known that titanium oxide has a photo-catalytic action and thereby decomposes organic matters. The mechanism of decomposing organic matters by the photo-catalytic action can be explained as follows. More specifically, when titanium oxide is irradiated with light beam such as visible radiation, ultraviolet rays, and the like, charge separation occurs so as to generate electrons and highly oxidizable electron holes. The electron holes react with water vapor or oxygen in the air to generate reaction active species such as OH radicals, $O_2^-$, etc. Such reaction active species instantaneously decompose organic matters existing around them. At present, titanium oxide is used for the purpose of environmental clean-up, for example, a deodorizing purpose, stain resisting purpose, an antibacterial purpose, etc. by using the photo-catalytic action.

However, when titanium oxide is used in a field of fibers, there are the following problems. First, since titanium oxide is provided in a form of powder, it can be mixed and added to the interior of synthetic fibers. However, since there is no effective method for attaching titanium oxide to natural fibers such as wool, cotton, etc., it has been difficult to attach titanium oxide to natural fibers. Furthermore, even if titanium oxide is attached to natural fibers by some means, the portion of the natural fiber to which titanium oxide is attached is deteriorated by the strong photo-catalytic action of titanium oxide and titanium oxide is easily peeled off. Moreover, as mentioned above, titanium oxide is activated only when ultraviolet rays are present in light to some extent, therefore titanium oxide does not exhibit a sufficient effect inside the house. Furthermore, when titanium oxide is allowed to attach to an animal fiber including protein as a main component, the fibers turn yellow due to the influence of titanium ion.

It is therefore an object of the present invention to provide a natural fiber containing titanium oxide that sufficiently exhibits various functions such as a deodorizing function, a stain resisting function, an antibacterial function, and the like, and to provide a process for producing the same by developing an effective method of attaching titanium oxide to natural fibers in which titanium oxide is not peeled off and no yellowing occurs.

DISCLOSURE OF INVENTION

In order to achieve the above-mentioned object, a natural fiber containing titanium oxide of the present invention has a surface that is plated with titanium oxide.

If the surface of the natural fiber is plated with titanium oxide like this way, the natural fiber per se is not deteriorated and not yellowed due to the photo-catalytic action of titanium oxide. Furthermore, since the attachment by plating is strong, titanium oxide does not peel off. Moreover, since titanium oxide is attached to the surface of the natural fiber, the photo-catalytic action of titanium oxide is sufficiently exhibited, thereby providing the natural fiber with excellent functions such as a deodorizing function, a stain resisting function, an antibacterial function, and the like.

Moreover, in the natural fiber of the present invention, the reason why the natural fiber per se to which titanium oxide is attached is not deteriorated is explained as follows. More specifically, titanium oxide acts on oxygen etc. with which it is in contact so as to produce active oxygen etc. However, the natural fiber of the present invention is plated with titanium oxide, titanium oxide is extremely closely attached to the natural fiber, so that oxygen, etc. cannot enter a place between the natural fiber and titanium oxide. Consequently, reaction active species such as active oxygen, etc. do not develop between the natural fiber and titanium oxide.

When the natural fiber of the present invention is plated with titanium oxide, either the entire or a part of the surface of the natural fiber may be coated with titanium oxide. Preferably, titanium oxide is uniformly attached to the surface of the natural fiber at the rate of 1 to 10% (more preferably at the rate of 2 to 5%) on an area basis.

In the present invention, the plating is not particularly limited, but a chemical plating is preferred.

It is preferable in the natural fiber containing titanium oxide of the present invention that the natural fiber contains protein and is treated to become anionic because the protein-containing natural fiber can further be prevented from yellowing.

It is preferable that the natural fiber is at least one fiber selected from the group consisting of wool, silk and cotton. It is particularly preferable that the natural fiber is an animal fiber such as wool and silk, etc. including protein as a main component.

It is preferable that the natural fiber containing titanium oxide of the present invention contains a noble metal in the plating of titanium oxide. By containing a noble metal, the effect of further improving the photo-catalytic action of titanium oxide can be obtained.

Moreover, in the present invention, titanium oxide and the noble metal in the natural fiber may be an ion or may not be an ion.

It is preferable that the natural fiber containing titanium oxide of the present invention contains gold in the plating of titanium oxide and has a function of oxidizing and decomposing organic matters even in conditions without light.

Next, a process for producing a natural fiber containing titanium oxide comprises plating the surface of the natural fiber with titanium oxide.

For the same reason as mentioned above, it is preferable that the natural fiber is treated to become anionic and then plated with titanium oxide.

It is preferable that natural fiber is treated to become anionic by using at least one acid selected from the group consisting of sulfamic acid, acetic acid, succinic anhydride and citraconic acid.

It is preferable in the process for producing a natural fiber containing titanium oxide of the present invention that a method of plating with titanium oxide comprises: preparing a solution containing titanium ion by adding at least one titanium compound of titanium alkoxide and titanium fluoride to an aqueous solvent; immersing a natural fiber treated to become anionic in this solution; further adding a mixture solution of boric acid, citric acid and D, L-malic acid to this solution and thereby changing the titanium ion to titanium oxide ion; and allowing the generated titanium oxide ion to deposit on the surface of the natural fiber so as to plate the surface.

For the same reason as mentioned above, it is preferable in the process for producing a natural fiber containing titanium oxide of the present invention that the natural fiber contains protein as a main component and a peptide bonding portion in the protein molecule is treated to become anionic. Furthermore, for the same reason as mentioned above, it is preferable that the natural fiber is at least one fiber selected from the group consisting of wool, silk and cotton. An animal fiber such as wool, silk, and the like, is particularly preferred.

It is preferable in the process for producing the natural fiber containing titanium oxide of the present invention that the surface of the natural fiber is plated with a noble metal in addition to titanium oxide.

BEST MODE FOR CARRYING OUT THE INVENTION

The natural fiber containing titanium oxide of the present invention is produced by, for example, the below mentioned process. Hereinafter, "% owf" represents weight % with respect to a processing weight of the natural fibers. For example, in a case where 3 kg of wool is processed, 5% owf additives means 150 g of additives.

First, the surface of the natural fiber is treated to become anionic. An example of techniques for treating to make the natural fibers anionic includes a method described in a literature concerning a treatment to make wool sulfamic (for example, "Chemical Treatment Designed to modify the affinity of wool for Dyes," JSDC Vol. 100 July/August 1984). Any methods described in the above-mentioned literature may be employed. For example, in the case of wool, a sufficiently scoured wool is immersed in a solution of acetic anhydride in dimethyl formamide (DMF). Thereby, a peptide bonding portion of protein forming wool is treated to become anionic. Moreover, the rate of the above-mentioned DMF and acetic anhydride is generally DMF of 70 to 99 weight % and acetic anhydride of 30 to 1 weight %, respectively for the total amount of DMF and acetic anhydride. Preferably, DMF is about 90 weight % and acetic anhydride is about 10 weight %. Furthermore, the treatment conditions are: generally, at the temperature of 20 to 60° C. and treatment time of 30 to 60 minutes, preferably, at the temperature of 50° C. and for about 30 minutes. Moreover, besides the above-mentioned acetic anhydride, sulfamic acid, succinic anhydride and citraconic acid, and the like, can be used for the treatment to make natural fibers anionic. Then, besides the above-mentioned DMF, examples of solvents for these acids include water and alcohol.

Next, at least one titanium compound of titanium alkoxide and titanium fluoride is dissolved in water so as to generate titanium ions in the solution. As the above-mentioned titanium alkoxide, for example, titanium methoxide, titanium ethoxide, etc. can be used. Furthermore, examples of the above-mentioned titanium fluoride include $TiF_3$, $TiF_4$, etc. The dissolving rate of the titanium compound to water is generally in the range from 0.5 to 5% owf, preferably about 2.0% owf. Moreover, changing of this rate enables adjusting of the rate of titanium oxide introduced into the surface of the natural fiber.

Next, the natural fiber treated to become anionic is immersed in the solution in which titanium ions are generated. In this case, wool turns yellow unless it is sufficiently treated to become anionic. Furthermore, it is preferable that the natural fiber is sufficiently washed in water before it is immersed in the solution.

Thereafter, a mixture of boric acid, citric acid and D, L-malic acid is added to this solution. By this process, titanium oxide ions are generated, deposited and attached to the surface of the natural fiber by the same principle as the chemical plating (electroless plating).

In a case where titanium fluoride is used as the titanium compound, fluoride ions of titanium fluoride in the solution are bonded to boric acid, while titanium in the solution is bonded to oxygen atoms. As a result, titanium oxide ions are generated. Extra titanium oxide ions are bonded to a decomposed product of citric acid and D, L malic acid at any time because an amino group of wool is anion-blocked, so that they form salt deposited in the solution and lose the reactivity. Furthermore, the generated titanium oxide ions are deposited, attached and bonded to the surface of the fiber by the same principle as the chemical plating (electroless plating).

The weight ratio of each component in the mixture is generally, boric acid:citric acid:D, L-malic acid = 0.1–10:1–100:1–100, preferably about 0.5 about 1: about 1. Furthermore, the adding rate of this mixture is generally 0.1 to 2 % owf, and preferably about 0.5% owf. Moreover, the treating condition is: generally, at the temperature of 20 to 60° C. for 30 to 60 minutes, referably, at the temperature of about 50° C. for about 30 minutes.

If the surface of the natural fiber is plated with titanium oxide in this way, titanium oxide is not peeled off until the natural fiber is fractured. Furthermore, the photo-catalytic reaction does not occur in the bonding portion between the natural fiber and titanium oxide, but it occurs at the boundary portion between titanium oxide exposed from the surface of the natural fiber and air, etc. Therefore, the attaching strength of titanium oxide by the photo-catalytic action is not deteriorated.

Moreover, in the present invention, titanium oxide to be plated is generally titanium dioxide, however, titanium monoxide, and titanium trioxide may be used. Furthermore, in titanium dioxide, anatase titanium dioxide having an excellent photo-catalytic function is preferred.

Thus, a natural fiber containing titanium oxide is produced. Moreover, the rate of titanium oxide introduced into the surface of the natural fiber containing titanium oxide is, as mentioned above, generally 1 to 10%, preferably 2 to 5% on the surface area basis. Furthermore, it is preferable that the titanium oxide is uniformly dispersed and attached to the surface of the natural fiber. In addition, the natural fiber containing titanium oxide of the present invention may be subjected to a specific processing treatment, for example, oiling after washing in water, etc.

As mentioned above, in the present invention, it is preferable that the surface of the natural fiber is plated with a noble metal, in addition to titanium oxide. Hereinafter, the combination of titanium oxide and noble metals will be explained.

(Combination of titanium oxide and gold)

When gold is attached to natural fibers, the reaction between active oxygen generated by the photo-catalytic action of titanium oxide and organic matters can be improved. For example, when titanium oxide and gold are attached to the surface of the fiber at the weight ratio of titanium oxide:gold of 1:0.001, a decomposition of dirt from organic matters such as tobacco tar can be improved. The active oxygen generated by titanium oxide has no selectivity in the reaction. However, by introducing gold into titanium oxide, the active oxygen can be made to selectively react with partially ionized harmful materials contained in smoke of tobacco. Moreover, the weight ratio of titanium oxide and gold on the surface of the natural fiber is generally titanium oxide: gold = 100–10000:1, preferably 1000–2000:1.

(Combination of titanium oxide and silver)

Theoretically, titanium oxide cannot promote the photo-catalytic action without light. On the other hand, it is known that silver can exhibit an antibacterial action and a deodorizing action even in conditions without light. Furthermore, silver hardly has toxicity. Therefore, silver has conventionally been used for a raw material of antibacterial agents and deodorants. Therefore, by attaching silver to the natural fiber in addition to titanium oxide, regardless of the presence of light, the antibacterial property and deodorizing effect can be expressed. Furthermore, by the action of silver, by using moisture and oxygen in the air, ozone can be generated, whereby the photo-catalytic reaction of titanium oxide can further be promoted. Moreover, the weight ratio of titanium oxide and silver is generally, titanium oxide silver = 10–100:1, preferably 50–60:1.

(titanium oxide and zirconium)

Zirconium ion has a highly active eight-coordination ion. When zirconium ion is introduced into the natural fiber along with titanium oxide, the photo-catalytic reaction of titanium oxide can be promoted. Moreover, the weight ratio of titanium oxide to zirconium is generally, 10–20:1, preferably 10:1.

Besides the above-mentioned combinations, combination of titanium oxide, silica and silver, and the like, can be employed. The common feature of all of the combinations of titanium oxide and noble metals is that the introduced noble metals promote or stabilize the photo-catalytic action of titanium oxide.

The noble metals can be introduced into the natural fibers in accordance with the plating of titanium oxide. For example, a compound of each noble metal is dissolved in water together with a titanium compound so as to generate noble metal ions and titanium ions. Examples of the above-mentioned compound of noble metals include, for example, gold chloride, silver nitrate, zirconium acetate, and the like. Furthermore, the dissolving rate of the noble metals in the compound is adjusted so as to be the ratio on the surface of the natural fiber. Moreover, as mentioned above, the natural fiber that is treated to become anionic is immersed in this solution and the above-mentioned mixture of citric acid, etc. is added, thereby allowing titanium oxide and noble metals to deposit on the surface of the natural fiber.

Hereinafter, the present invention will be described by way of Examples.

EXAMPLE 1

Wool containing titanium oxide was produced by introducing titanium oxide into wool by the below mentioned method.

First, the wool was sufficiently scoured as follows. First, a surface active agent (NOIGEN EA 120: NOIGEN EA 80 (produced by Dai-ichi Kogyo Seiyaku Co., Ltd.) = 90:10 in the weight ratio) was dissolved in water at the rate of 5 g/liter. Then, 1 part by weight of wool was immersed in 20 parts by weight of this solution and treated at 90° C. for 3 minutes. Thereafter, the wool was washed in water at 40° C. twice. Thus, the scouring was completed. Next, the scoured wool was immersed in a solution of acetic anhydride (10 eight %) in DMF (90 weight %). The solution containing the above-mentioned scoured wool is heated to 50° C. and kept at this temperature for 30 minutes so as to make the wool anionic. Thereafter, the wool treated to become anionic was washed in water. On the other hand, titanium alkoxide (kinds: titanium ethoxide) was dissolved in water at the rate of 2.0% owf. The wool treated to become anionic was immersed in this solution and treated at room temperature for 30 minutes. Then, a mixture in which boric acid, citric acid and D, L- malic acid are mixed at the weight ratio of boric acid:citric acid:D, L- malic acid of 0.5:1:1 was added to this solution at the rate of 0.5% owf and treated at 50° C. for 30 minutes. Thereafter, the mixture was washed in water so as to obtain the intended titanium oxide.

The thus obtained wool containing titanium oxide of Example 1 was evaluated in terms of antibacterial property, deodorizing property, stain resisting property, peeling of titanium oxide and yellowing of the wool. The determination was carried out by the following method. The results are shown in the following Tables 1, 2, 3, 4 and 5, respectively. Moreover, in these Tables, the treated wool denotes the wool of Example 1, untreated wool is one that was not subjected to the treatment of Example 1.

(Antibacterial property)

An antibacterial property was evaluated by the Shake Flask Method specified by Association of Antilacteral Treatments for Textiles, Japan, SEK. As test bacterial strains, Klebsiella (Klebsiella pneumonise IFO 13277) and *Staphylococcus aureus* (Staphylococcus aureus FAD 209P) were used. Table 1 shows the results. Moreover, values in the Tables are average values of the number (number per ml) of live bacterial strains of three kinds of test samples.

TABLE 1

| Sample | Right after preparation | At 1 hour | Rate of sterilization (%) |
|---|---|---|---|
| <Antibacterial property> | | | |
| 1. *Klebsiella pneumonise* | | | |
| Untreated wool | $1.72 \times 10^4$ | $1.61 \times 10^4$ | 6.4 |
| Treated wool | $1.72 \times 10^4$ | $1.83 \times 10^2$ | 89.4 |
| 2. *Staphylococcus aureus* | | | |
| Untreated wool | $1.22 \times 10^4$ | $1.24 \times 10^4$ | −1.6 |
| Treated wool | $1.22 \times 10^4$ | 500 | 95.9 |

(Deodorizing property)

The deodorizing property was evaluated by the teddler-pack (Tedler-bag) method. More specifically, ammonia, hydrogen sulfide and acetic acid of a known concentration were filled in a teddler-pack (volume: 3000 ml), and test samples were added thereto, the change of gas concentration was measured by using a gas-tech detector (gas detecting tube) at an initial time of sealing, 5 minutes, 30 minutes and 60 minutes. This operation was carried out in irradiation with light and in the dark, and both resultant deodorizing properties were compared. Table 2 shows the results.

TABLE 2

| | Initial value (ppm) | At 5 minutes (ppm) | At 30 minutes (ppm) | At 60 minutes (ppm) |
|---|---|---|---|---|
| 1. In irradiation with light (10 cm below a 30 W fluorescent light) | | | | |
| Ammonia | | | | |
| Untreated wool | 300 | 280 | 240 | 200 |
| Treated wool | 300 | 250 | 120 | 30 |
| Hydrogen sulfide | | | | |
| Untreated wool | 30 | 30 | 29 | 29 |
| Treated wool | 30 | 25 | 10 | 5 |

TABLE 2-continued

| | Initial value (ppm) | At 5 minutes (ppm) | At 30 minutes (ppm) | At 60 minutes (ppm) |
|---|---|---|---|---|
| Acetic acid | | | | |
| Untreated wool | 100 | 70 | 55 | 40 |
| Treated wool | 100 | 70 | 40 | 10 |
| 2. In the dark (in conditions without light) | | | | |
| Ammonia | | | | |
| Untreated wool | 300 | 280 | 240 | 200 |
| Treated wool | 300 | 270 | 240 | 200 |
| Hydrogen sulfide | | | | |
| Untreated wool | 30 | 30 | 29 | 29 |
| Treated wool | 30 | 30 | 29 | 29 |
| Acetic acid | | | | |
| Untreated wool | 100 | 70 | 55 | 40 |
| Treated wool | 100 | 70 | 50 | 40 |

(stain resisting property)

One gram of instant coffee (trade name: NESCAFE GOLD BLEND produced by NestléJapan Limited) and 1 gram of dark soy source were added to 100 ml of water to prepare an artificial contaminated liquid. A test sample was immersed in the artificial contaminated liquid and then dried (by Pad-Dry) to prepare a dirty test sample. On the other hand, a test sample that was not treated with titanium oxide was prepared. The untreated test sample was immersed in the above-mentioned contaminated liquid and then dried. The untreated test sample was made a control sample. These samples were placed 10 cm below a 30 W fluorescent light and exposed to light for 20 hours, and initial coloring of the samples and coloring after the samples were exposed to light for 20 hours were determined by using a color-difference meter. Table 3 shows the results.

TABLE 3

<Stain resisting property>
After exposed to light irradiation (10 cm below a 30 W fluorescent light) for 20 hours.

| | Initial coloring | Coloring after 20 hours |
|---|---|---|
| Untreated wool (control) | 100 | 85 |
| Treated wool | 100 | 52 |

(Peeling degree of titanium oxide)

The peeling degree of titanium oxide was investigated in accordance with JIS L 0860 (durability test for dry cleaning). More specifically, 50 g of wool treated with titanium oxide was prepared. The amount of titanium oxide in the wool treated with titanium oxide before dry cleaning, after dry cleaning 10 times and after dry cleaning 20 times were measured. The amount of titanium oxide was measured by burning each of the above-mentioned wool treated with titanium oxide in an electric furnace at 1000° C. and then measuring the weight of the residual titanium oxide. The peeling degree of titanium oxide was evaluated as the rate of titanium oxide after dry cleaning with respect to the amount of titanium oxide before dry cleaning. Table 4 shows the results. In Table 4, the amount of attached titanium oxide was shown as the rate with respect to an entire amount of 50 g of wool treated with titanium oxide.

TABLE 4

<Peeling degree of titanium oxide>

| | Amount of attached titanium oxide (%) | Peeling degree (%) |
|---|---|---|
| Initial time | 0.34 | — |
| After dry cleaning 10 times | 0.33 | 2.9 |
| After dry cleaning 20 times | 0.32 | 5.9 |

(Yellowing of wool)

Yellowing degree (Δb) was measured by using a color-difference meter by making an untreated wool the reference. Furthermore, in Example 1-b, the yellowing degree of the wool treated with titanium oxide (without a treatment to make the wool anionic) was also investigated by the deposition by using the reduction potential of wool protein. Table 5 shows the measuring results of yellowing.

TABLE 5

| | Example 1 | Example 1-b |
|---|---|---|
| Yellowing degree (Δb) | 0.18 | 6.3 |

As is apparent from these evaluation results, the wool containing titanium oxide had an antibacterial property, deodorizing property and stain resisting property, caused no peeling of titanium oxide. Furthermore, the yellowing of wool was also inhibited. Furthermore, the yellowing of the wool that was not treated to become anionic was within the permissible range, however, the yellowing of the wool that was treated to make anionic was extremely low.

EXAMPLE 2

The same operation as that of Example 1 was carried out except that titanium fluoride ($TiF_4$) was used instead of titanium alkoxide, and thus a wool containing titanium oxide was produced.

The wool containing titanium oxide of Example 2 was investigated in terms of the antibacterial property, deodorizing property, stain resisting property, peeling degree of titanium oxide and the yellowing of wool. The results were equal to or more preferable than those of Example 1.

EXAMPLE 3

Wool was treated with titanium oxide and gold by the following method. First, titanium alkoxide was used so as to generate titanium ions in a solution as mentioned above. Furthermore, gold chloride was added (at the rate of 0.001 with respect to the above-mentioned titanium oxide) so as to generate gold ions as well as titanium ions in this solution. Then, similar to Example 1, a mixture of boric acid (a), citric acid (b) and D, L- malic acid (c) (the mixing ratio of a:b:c = 0.5:1:1) was added to the solution, whereby titanium oxide ions were generated in the solution. Then, the generated titanium ions and gold ions were deposited and strongly attached to the fiber surface of wool by the same principle as a chemical plating (electroless plating). At this time, it was thought that the above-mentioned gold ions were absorbed (i.e. doping) between molecules of titanium ions.

The thus attached titanium oxide and gold were not peeled off until the fiber was fractured. Furthermore, the photo-catalytic reaction did not occur at a attaching site of titanium oxide and gold but occurred at the boundary between titanium oxide and gold and air, etc. Therefore, the attaching strength was not deteriorated. These things were apparent from the below mentioned evaluation of Example.

Then, the thus obtained wool treated with titanium oxide and gold was evaluated in terms of the anitbacterial property, deodorizing property, stain resisting property, and peeling of titanium oxide by the above-mentioned method. The results are shown in Tables 6, 7, 8 and 9, respectively. In these tables, the treated wool denotes the wool of Example 3, and the untreated wool denotes wool that was not treated of Example 3.

Moreover, the peeling test of titanium oxide was carried out by the method in accordance with JIS L 0217 103 by using a domestic washing machine. Other conditions were the same as the above.

TABLE 6

| Test sample | Right after treatment | At 1 hour | Rate of sterilization (%) |
|---|---|---|---|
| <antibacterial property> | | | |
| 1. *Klebsiella pneumonise* | | | |
| Untreated wool | $1.90 \times 10^4$ | $1.97 \times 10^4$ | −6.4 |
| Treated wool | $1.90 \times 10^4$ | 50 | 99.7 |
| 2. *Staphylococcus aureus* | | | |
| Untreated wool | $1.64 \times 10^4$ | $1.75 \times 10^4$ | −6.7 |
| Treated wool | $1.64 \times 10^4$ | 20 | 99.9 |

TABLE 7

| | Initial value (ppm) | At 5 minutes (ppm) | At 30 minutes (ppm) | At 60 minutes (ppm) |
|---|---|---|---|---|
| <deodorizing property> | | | | |
| 1. In irradiation with light (10 cm below a 30 W fluorescent light) | | | | |
| (Ammonia) | | | | |
| Untreated wool | 300 | 280 | 240 | 200 |
| Treated wool | 300 | 150 | 20 | 0 |
| (Hydrogen sulfide) | | | | |
| Untreated wool | 30 | 30 | 29 | 29 |
| Treated wool | 30 | 20 | 10 | 5 |
| (Acetic acid) | | | | |
| Untreated wool | 100 | 70 | 55 | 40 |
| Treated wool | 100 | 20 | 10 | 0 |
| 2. In the dark (in conditions without light) | | | | |
| (Ammonia) | | | | |
| Untreated wool | 300 | 280 | 240 | 200 |
| Treated wool | 300 | 170 | 40 | 0 |
| (Hydrogen sulfide) | | | | |
| Untreated wool | 30 | 30 | 29 | 29 |
| Treated wool | 30 | 20 | 9 | 0 |
| (Acetic acid) | | | | |
| Untreated wool | 100 | 70 | 55 | 40 |
| Treated wool | 100 | 20 | 0 | 0 |

TABLE 8

<Stain resisting property>
After exposed to light irradiation (10 cm below a 30 W fluorescent light) for 20 hours.

| | Initial coloring | Coloring after 20 hours |
|---|---|---|
| Untreated wool (control) | 100 | 85 |
| Treated wool | 100 | 22 |

TABLE 9

<Peeling degree of titanium oxide>

| | Amount of attached titanium oxide (%) | Peeling degree (%) |
|---|---|---|
| Initial value | 0.52 | — |
| After dry cleaning 10 times | 0.51 | 1.9 |
| After dry cleaning 20 times | 0.48 | 7.7 |

As a result of the above-mentioned evaluations, the wool containing gold as well as titanium oxide is excellent in the antibacterial property, deodorizing property, and stain resisting property and does not exhibit the peeling of titanium oxide and gold. Furthermore, surprisingly, in a test of deodorizing property that was evaluated in the dark (in conditions without light), when the wool was treated with titanium oxide and gold, it was confirmed that the organic gas of ammonium, etc. was decomposed.

INDUSTRIAL APPLICABILITY

As mentioned above, in the natural fiber containing titanium oxide of the present invention, titanium oxide is attached to the fiber surface without possibility of peeling off by plating titanium oxide on the surface of the fiber. Therefore, the natural fiber containing titanium oxide of the present invention has various functions such as an antibacterial function, a deodorizing function and an anitfouling function by the excellent photo-catalytic effect of titanium oxide. In addition, since the above-mentioned photo-catalytic action was expressed by absorbing ultraviolet rays by titanium oxide, the natural fiber containing titanium oxide of the present invention also has an effect of inhibiting ultraviolet rays (so called UV cut effect). Furthermore, titanium oxide also has a masking effect. Therefore, in the natural fiber containing titanium oxide of the present invention, by adjusting the incorporating rate of titanium oxide, the base color of natural fiber can be masked, and further, by using titan white that is excellent as a white pigment, bright pure-white natural fiber can be produced. In addition, when a noble metal is added in addition to titanium oxide, the photo-catalytic function of titanium oxide can further be promoted. Furthermore, the natural fiber can be provided with various functions of the noble metal.

What is claimed is:

1. A natural organic fiber comprising a surface that is plated with titanium oxide, wherein deterioration of said natural organic fiber by titanium oxide does not occur; and wherein said titanium oxide is closely attached to the surface of said natural organic fiber.

2. The natural organic fiber according to claim 1, wherein the natural organic fiber contains protein and wherein the natural organic fiber is treated to become anionic by using at least one acid selected from the group consisting of sulfamic acid, acetic anhydride, succinic anhydride and citraconic acid.

3. The natural organic fiber according to claim 2, wherein the natural organic fiber is at least one fiber selected from the group consisting of wool, silk and cotton.

4. The natural organic fiber according to claim 2, wherein the natural fiber is plated with a noble metal and titanium oxide.

5. The natural organic fiber according to claim 4, wherein the noble metal is gold and wherein the natural organic fiber exhibits a function of oxidizing and decomposing organic matter even in conditions without light.

6. A process for producing a titanium oxide-plated natural organic fiber comprising the steps of: preparing a solution containing titanium ions by adding at least one titanium compound of titanium alkoxide and titanium fluoride to an aqueous solvent; immersing a natural organic fiber in the solution; and further adding boric acid, citric acid and D,L-malic acid to the solution, wherein titanium oxide is deposited onto the surface of said natural organic fiber so as to plate the surface.

7. The process for producing a titanium oxide-plated natural organic fiber according to claim 6, comprising treating the natural organic fiber to make it anionic and then immersing the natural organic fiber in a titanium-containing liquid.

8. The process for producing a titanium oxide-plated natural organic fiber according to claim 7, wherein the natural organic fiber is treated with at least one acid selected from the group consisting of sulfamic acid, acetic anhydride, succinic anhydride and citraconic acid to make the natural organic fiber anionic.

9. The process for producing a titanium oxide-plated natural organic fiber according to claim 7, wherein the natural organic fiber contains protein and a peptide bonding portion of the protein is treated to become anionic.

10. The process for producing a titanium oxide-plated natural organic fiber according to claim 9, wherein the natural organic fiber is at least one fiber selected from the group consisting of wool, silk, and cotton.

11. The process for producing a titanium oxide-plated natural organic fiber containing titanium oxide according to claim 6, wherein a noble metal is also plated on the surface of natural organic fiber.

12. A titanium oxide-plated natural organic fiber obtained by a process comprising the steps of: preparing a solution containing titanium ions by adding at least one titanium compound of titanium alkoxide and titanium fluoride to an aqueous solvent; immersing a natural organic fiber in the solution containing titanium ions; and further adding boric acid, citric acid and D,L-malic acid to the solution, wherein titanium oxide is deposited onto the surface of said natural organic fiber so as to plate the surface.

13. The natural organic fiber according to claim 1, wherein the natural organic fiber is wool and a peeling degree of titanium oxide according to JIGS L 0860 is less than 10%.

14. The titanium oxide-plated natural organic fiber according to claim 1, wherein the titanium oxide is anatase titanium oxide.

15. The titanium oxide-plated natural organic fiber according to claim 2, wherein the titanium oxide is anatase titanium oxide.

16. The titanium oxide-plated natural organic fiber according to claim 3, wherein the titanium oxide is anatase titanium oxide.

17. The titanium oxide-plated natural organic fiber according to claim 4, wherein the titanium oxide is anatase titanium oxide.

18. The titanium oxide-plated natural organic fiber according to claim 5, wherein the titanium oxide is anatase titanium oxide.

19. The titanium oxide-plated natural organic fiber according to claim 12, wherein the titanium oxide is anatase titanium oxide.

20. The titanium oxide-plated natural organic fiber according to claim 13, wherein the titanium oxide is anatase titanium oxide.

* * * * *